United States Patent [19]

Berzanske

[11] 3,966,371

[45] June 29, 1976

[54] ROTARY, POSITIVE DISPLACEMENT PROGRESSING CAVITY DEVICE

[76] Inventor: Lawrence W. Berzanske, 8000 Garfield Road, Mentor, Ohio 44060

[22] Filed: Feb. 19, 1975

[21] Appl. No.: 551,028

Related U.S. Application Data

[63] Continuation of Ser. No. 412,205, Nov. 2, 1973, abandoned.

[52] U.S. Cl. ..... 418/197

[51] Int. Cl.[2] ..... F04C 17/04

[58] Field of Search ..... 418/196, 197

[56] References Cited

UNITED STATES PATENTS

| | | | |
|---|---|---|---|
| 1,164,546 | 12/1915 | Neuland | 418/197 |
| 1,656,538 | 1/1928 | Smith | 418/196 X |
| 2,410,341 | 10/1946 | Delamere | 418/197 |
| 3,234,888 | 2/1966 | Wise et al. | 418/196 X |
| 3,439,654 | 4/1969 | Campbell | 418/196 X |
| 3,574,488 | 4/1971 | Drake | 418/197 X |

*Primary Examiner*—Carlton R. Croyle
*Assistant Examiner*—Edward Look
*Attorney, Agent, or Firm*—Bosworth, Sessions & McCoy

[57] ABSTRACT

A positive displacement, progressing cavity device with interengaging axially twisted rotors that define sealed cavities or chambers which develop at the inlet of the device and progress axially to the outlet of the device in response to synchronized rotor rotation.

As the cavities or chambers progress axially they may be constant in volume, increasing in volume, decreasing in volume or any combination of constant, increasing and decreasing volume depending on the change in pitch of the axial twist of the rotors. All rotors of any one device are identical in geometric configuration and are arranged in groups of four, such that each rotor is in constant engagement with its adjacent rotors.

3 Claims, 11 Drawing Figures

ROTARY, POSITIVE DISPLACEMENT PROGRESSING CAVITY DEVICE

This is a continuation of application Ser. No. 412,205, filed Nov. 2, 1973, now abandoned.

BACKGROUND OF THE INVENTION

This invention relates to positive displacement devices such as pumps and motors and especially to rotary-type devices as opposed to those that reciprocate (e.g., piston type). More particularly, the invention relates to such rotary devices wherein sealed cavities or chambers progress axially or in a direction generally parallel to an axis of rotation from an inlet to an outlet.

The several forms and variations of the invention may be adapted for use as a pump or motor for liquids and/or comminuted material, or as an expander or compressor for gases. The sealed cavities or chambers may be of constant volume during their axial progression as in the case of liquid pumps or motors or may have an expanding or diminishing volume as in the case of expanders or compressors for a gaseous medium. Alternatively, the device may be designed to first compress the chamber volume and then subsequently to expand it as in the case of an internal combustion engine.

The device of the invention constitutes an entirely new class of rotary motion devices, for use in connection with a liquid or gaseous medium and utilizes a revolutionary new mechanical concept that can be embodied in many and various applications.

While the device of the invention in its various forms utilizes three dimensional geometrical relationships with complex surface forms, one presently-known aspect of the unique geometry involved may be considered with respect to two-dimensional plane figures. This two-dimensional aspect is illustrated and described to a limited extent in U.S. Pat. No. 3,234,888 to Wise et al. and in U.S. Pat. No. 3,439,654 to Campbell.

More specifically, the two-dimensional expanding chamber device, as shown in the patent to Wise, has four elliptical impellers with symetrically spaced, parallel axes of rotation through their respective geometric centers to define along with the end walls of the device, a pumping cavity enclosed therebetween. The size of the cavity or chamber thus defined varies between minimum and maximum volumes depending on the relative orientation of the impellers throughout a rotary cycle. Also, suitable porting is provided for the fluid being pumped. The impellers are all driven through intermeshing gears to provide a synchronized rotation.

This same class of mechanical rotary motion devices is utilized in the internal combustion engine of the aforesaid Campbell patent wherein four cam pistons that rotate in synchronization are used to form an expanding and contracting combustion chamber. Here the rotary cam pistons are in the form of two-lobed, two-dimensional elements defined by two matching 90° arcuate segments of a circle. Seals are provided at the tips of the cam pistons and a central post is located in the combustion chamber to cooperate with the seals and provide one intermittent condition wherein the chamber volume is essentially zero.

As indicated, these known mechanisms are essentially two-dimensional expanding chamber devices wherein porting is provided to transmit fluid to and from the chamber or cavity. The rotors alone do not define the enclosed volume but cooperate with end plates to define the expanding chamber.

The device of the present invention utilizes the two-dimensional geometric concept described above in that it adapts this concept to a three-dimensional axial flow concept wherein the chambers or cavities progress in an axial direction and are defined by the uniquely shaped surfaces of the interengaging rotors. Accordingly, the device of the present invention constitutes an entirely new concept in rotary motion mechanical devices and affords revolutionary new features heretofore not obtainable.

SUMMARY OF THE INVENTION

It is among the objects of the invention to provide a rotary motion, positive displacement, mechanical device adapted for use as a liquid medium pump or motor, a gaseous medium expander or compressor, or an axial flow internal combustion engine.

These and other objects and advantages are achieved by the revolutionary new concept of the invention as embodied in a device utilizing complex, three-dimensional surface forms and including a fluid inlet and fluid outlet spaced from one another at opposite ends of a central flow axis. Four interengaging axially twisted rotors are symmetrically spaced around the central flow axis and adapted for rotation about their respective axes of symmetry. The rotors as viewed in transverse cross section define four, two-lobed plane figures, each in the same orientation relative to a radial line from its axis to the central flow axis, and each in engagement with the two adjacent plane figures throughout the synchronized rotation. The plane figures thus define therebetween an enclosed region that varies from a maximum area when the plane figures are orientated perpendicular to their respective radial lines to the central flow axis, to a zero area (i.e., sealing condition) when the plane figures are orientated in alignment with their respective radial lines to the central flow axis.

Each rotor has an axially twisted surface form generated by translating the respective two-lobed plane figure along the respective rotor axis while rotating it about its rotor axis. The resulting helical surface forms of the rotor are essentially identical in pitch and cross-sectional shape. The rotors are arranged to interengage and define therebetween one or more closed cavities or chambers that progress axially along the central flow axis from the inlet to the outlet in response to the synchronized rotation of the rotors.

If desired, the pitch of the helical rotors may be varied either uniformally or non-uniformally from end-to-end so that the volume of the cavity either increases or decreases during its axial progression. Also the rotors, instead of having their axes parallel, may have them uniformally angled relative to the central flow axis to define, for example, a frustom of a regular pyramid or tetrahedron.

Alternatively, the device may have both uniformally angled rotor axes as well as rotors with a varying pitch to achieve chamber compression or expansion.

As another alternative, the device may employ both chamber compression and expansion such as, for example, for utilizing it as a rotary, internal combustion engine.

DESCRIPTION OF THE PREFERRED EMBODIMENTS

Figure 1:
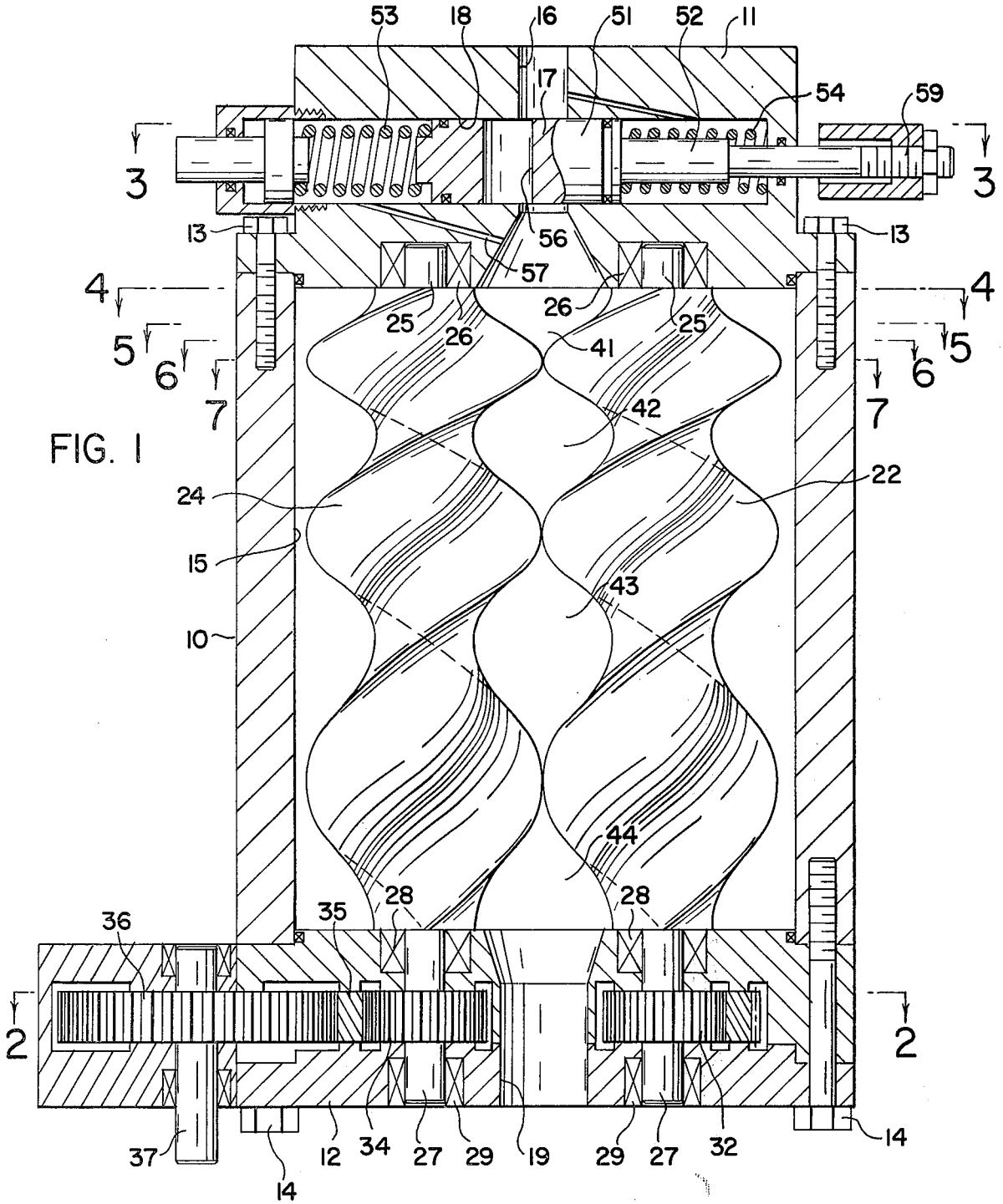
FIG. 1 is a longitudinal sectional view through a steam expander embodying the invention.

Referring more particularly to the drawings and initially to FIGS. 1 through 7, there is shown a particular embodiment of the invention in the form of a device for use as a gaseous expander, such as, for example, in a steam engine. The device comprises a cylindrical housing 10, a head plate 11 bolted to the forward end of the housing 10 with machine screws 13 and a tail plate 12 bolted to the rearward end of the housing with machine screws 14. The housing 10 defines a cylindrical enclosure 15 about a central flow axis.

The front plate 11 has an inlet port 16 with an intermediate inlet valve 17 that is reciprocal in a slot 18 formed in the head plate 11. The construction of the inlet valve 17 will be discussed in more detail below. The rear plate 12 has a central outlet port 19 which exhausts expanded gas.

Figure 2:
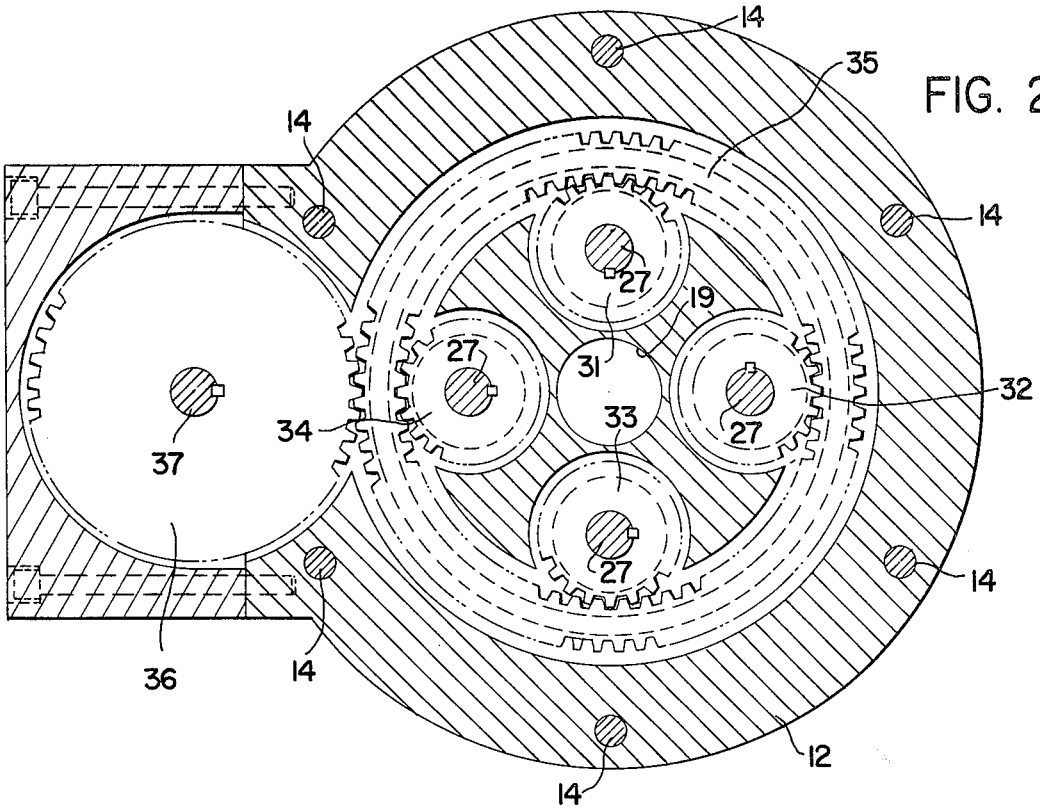
FIG. 2 is a transverse sectional view taken on the line 2—2 of FIG. 1.
Figure 3:
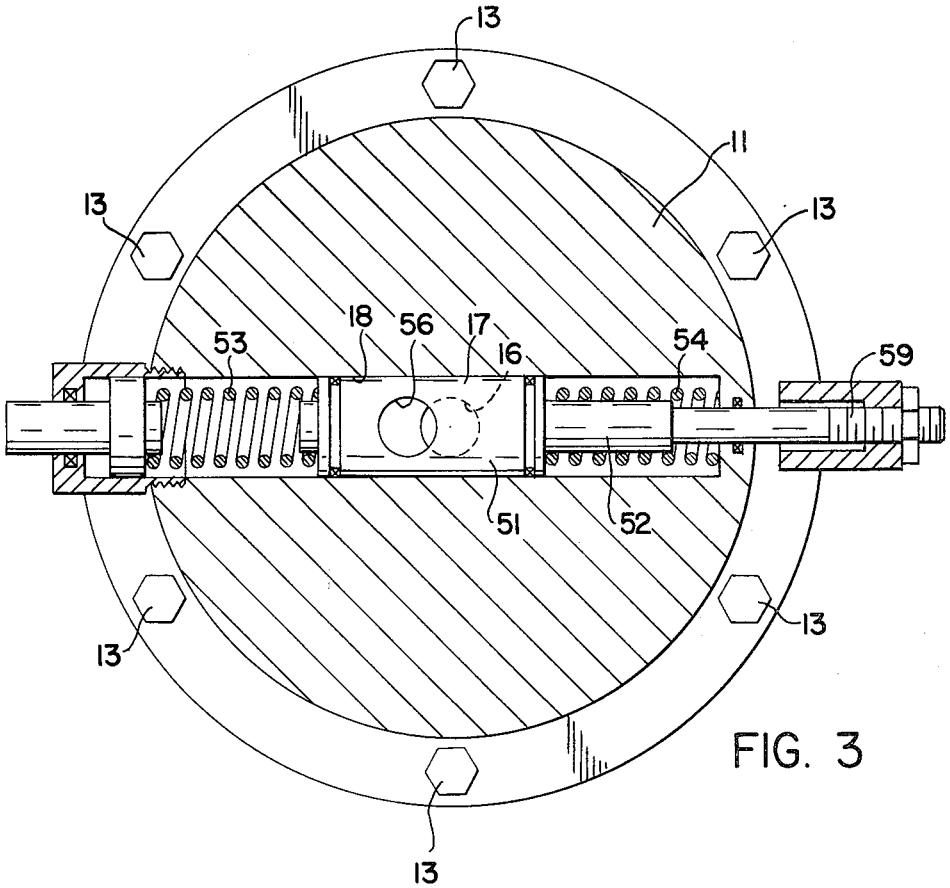
FIG. 3 is a transverse sectional view taken on the line 3—3 of FIG. 1.

Located within the enclosure 15 are four synchronized interengaging helical rotors 21, 22, 23 and 24 positioned with their axes of rotation symmetrically and uniformally spaced about the central flow axis and parallel thereto. The helical surface form of the rotors 21 through 24 will be described in greater detail below. Each rotor has a stub axle 25 journaled in bearings 26 in a head plate 11 and a drive shaft 27 at the other end journaled in two sets of spaced journal bearings 28 and 29 in the tail plate 12. Each of the drive shafts 27 has a pinion 31, 32, 33 and 34 respectively keyed thereto as best illustrated in FIG. 2.

The pinions 31 to 34 engage internal gear teeth in a ring gear 35 that is also provided with external gear teeth that engage an output pinion 36 keyed to an output shaft 37. Thus, as the helical rotors 21 through 24 are rotated by the force of the expanding gas the respective pinions 31 to 34 serve to drive the output shaft 37 which is conventionally connected to a suitable load.

Rotor Geometry

Figure 4:
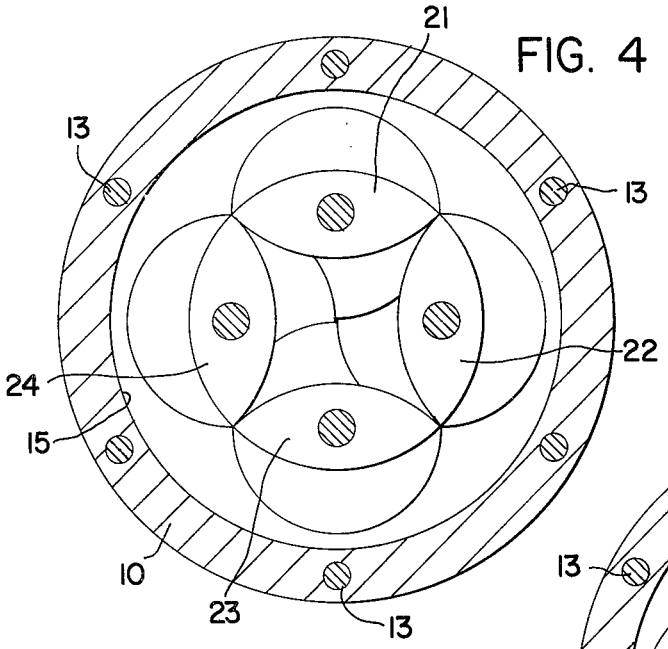
FIG. 4 is a transverse sectional view taken on the line 4—4 of FIG. 1.
Figure 5:
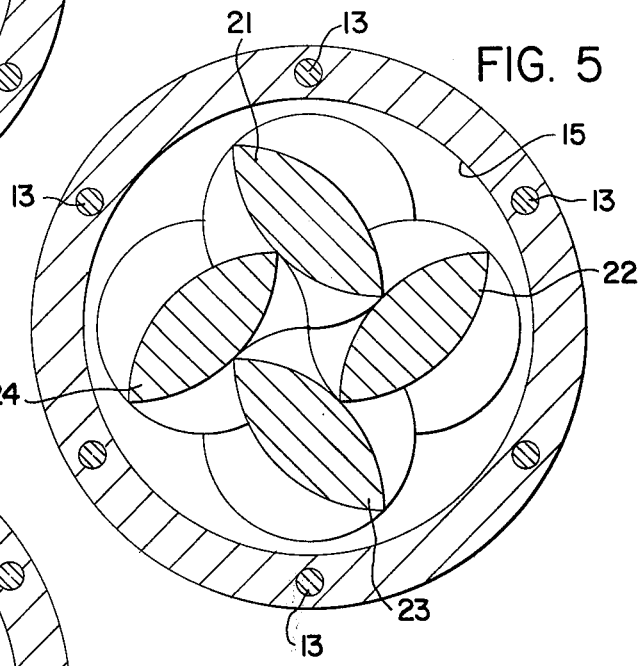
FIG. 5 is a transverse sectional view taken on the line 5—5 of FIG. 1.

Referring to FIGS. 4 through 7, it will be seen that, as viewed in cross section, the rotors 21, 22, 23 and 24 appear as two-lobed plane figures with each figure being defined by two matching 90° circular segments. The plane figures are symmetrical about their geometric centers and are continuously in the same orientation relative to a radial line from their respective centers thereof to the central flow axis. Referring first to FIG. 4, it will be seen that the plane figures are aligned perpendicular to a radial line from the central flow axis to their respective geometric centers and that the tips are all in mutual contact to define an enclosed region with four concavely curved sides. Still referring to FIG. 4, it will be seen that if the plane figures are rotated in synchronization they will, after turning 90°, be positioned with their tips in mutual contact at the central flow axis so that the volume of the enclosed region will be reduced essentially to zero. Thus, the enclosed region varies in area from a maximum size when the plane figures are perpendicular to a radial line from their axes to the central flow axis, to a minimum volume when the plane figures are in alignment with the radial line from the central flow axis.

The helical surface form of each rotor is generated by translating a plane figure as discussed above axially along the rotor axis while rotating it about the axis. In the present case, the pitch is not uniform but rather increases at a uniform rate from the head end to the tail end of the device. In other types of devices utilizing the invention, such as in fluid pumps, the pitch would be constant so there would be no variation in the volume of the pumping chambers as they progress in an axial direction.

Figure 6:
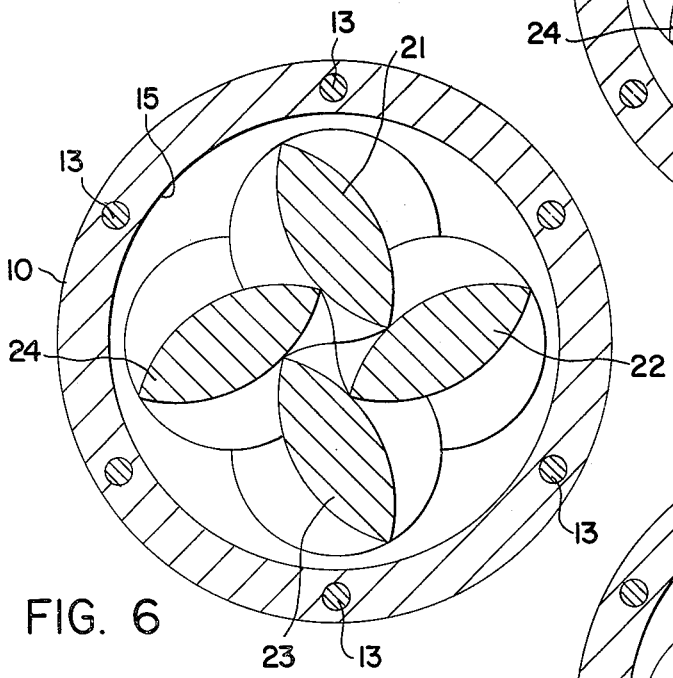
FIG. 6 is a transverse sectional view taken on the line 6—6 of FIG. 1.

With the same identical axial twist provided for each of the rotors 21 to 24, it will be seen that with the rotors in a static condition, axially progressing cross sections will produce plane figures in different relative positions about their geometric centers so that the area of the enclosed region will vary. Thus, in FIG. 5 the plane figures defined by the transverse section are each aligned at about a 45° angle relative to a radial line from the central flow axis to their respective geometric centers. Accordingly, the area of the enclosed region is substantially reduced from that of FIG. 4. In FIG. 6 the plane figures are viewed as being rotated to an angle to about 30° relative to a radial line from the central flow axis to their respective geometric centers and an even greater reduction in the area of the enclosed region is apparent.

Figure 7:
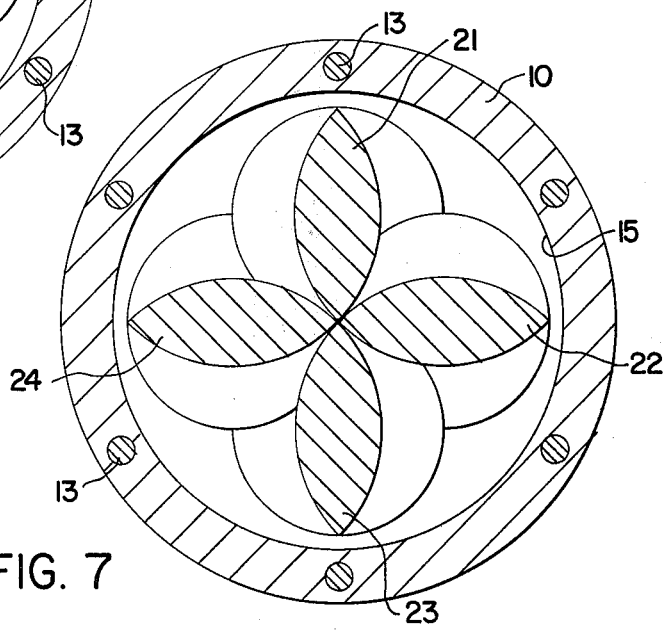
FIG. 7 is a transverse sectional view taken on the line 7—7 of FIG. 1.

Finally in FIG. 7 the plane figures are shown as having rotated a full 90° from the starting position of FIG. 4 so that the enclosed region has been virtually eliminated. These sectional views (FIGS. 4 through 7) taken at spaced locations along the flow axis thus illustrate to some extent the nature of the pumping cavities defined by the interengaging rotors 21, 22, 23 and 24. In the embodiment shown, four pumping cavities are illustrated including an entry cavity 41, two fully sealed intermediate cavities 42 and 43, and a partially opened cavity 44 at the outlet end of the device. The cavity 41 at the inlet end is in the process of being formed and about 1/2 of its volume has been defined by the rotors. The cavity 42 is fully enclosed and it will be seen that it comprises a volume with four curved sides the sides being twisted as well as convexly curved. The cavities 42 and 43 are defined entirely by the surfaces of the four rotors so that all of the necessary sealing occurs between the surfaces of the rotors themselves.

Due to the increasing pitch of the rotor surface forms the enclosed volumes become progressively greater as they progress axially from the inlet to the outlet of the device. The device has particular utility in connection with power generation through steam expansion since by varying the pitch the necessary expansion ratio can be provided. It will be noted that the volume of the pockets is directly proportional to the pitch of the helical rotors.

Inlet Valve

The inlet valve 17 comprises a slide 51 on a pin 52, the opposite ends of which extend through helical springs 53 and 54. The slide 51 has a valve port 56 which is movable into and out of registration with the inlet port 16. Under normal operating conditions the slide 51 positions the port 56 in registration with the inlet port. However, if back pressure from the inlet chamber increases due to an increased load, the increased pressure will be transmitted through a lateral port 57 through the left-hand end of the slot. The resulting pressure will shift the valve to the right, as viewed in FIGS. 1 and 2, to a new balance point between the springs 52 and 53 to maintain a constant speed. A decrease in the load will also be sensed and will cause necessary shifting and rebalancing of the slide. A control pin 59 extending from the head plate 11 may be used to control the speed of the device by changing the balance point for the valve port.

Figure 8:
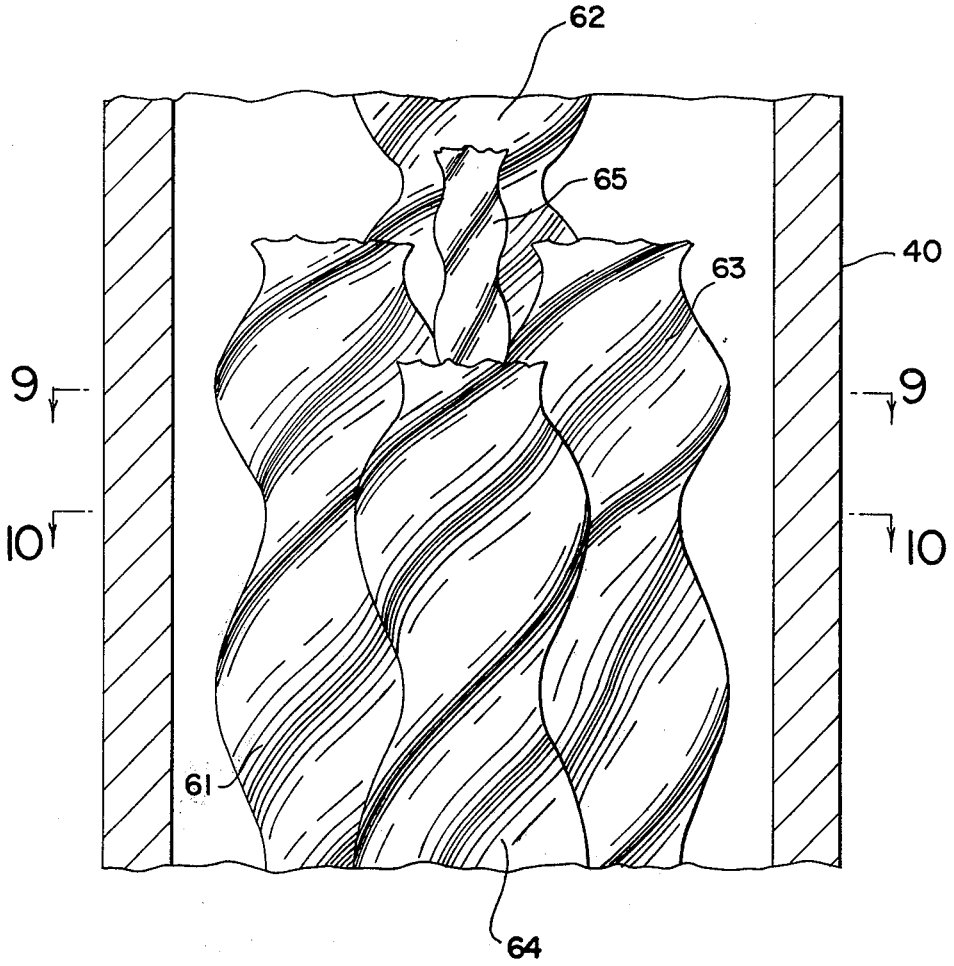
FIG. 8 is a fragmentary elevational view, partly in section, illustrating pump embodying an alternate form of the invention.
Figure 9:
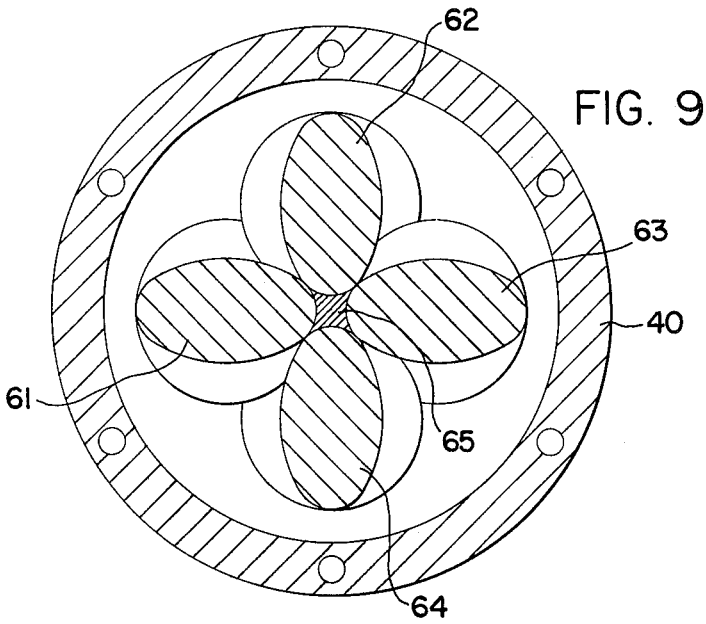
FIG. 9 is a transverse sectional view taken on the line 9—9 of FIG. 8.
Figure 10:
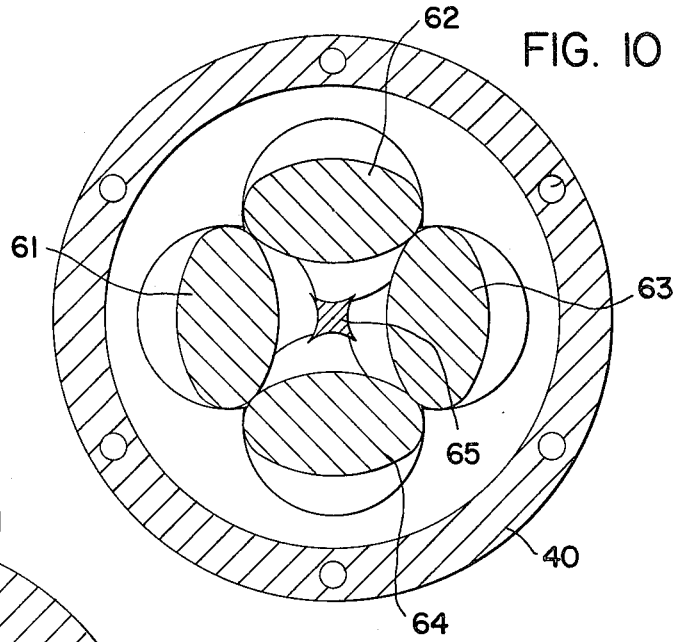
FIG. 10 is a transverse sectional view taken on the line 10—10 of FIG. 8.

FIGS. 8, 9 and 10

FIGS. 8, 9 and 10 illustrate an alternate form of the invention wherein the axially twisted rotors are formed with rounded lobes rather than pointed lobes as in the case of the embodiment illustrated in FIGS. 1 through 7. For the purpose of illustration, this modified form is illustrated in connection with a compressor for a gaseous medium. The device is shown in a fragmented manner in order to illustrate those portions thereof embodying the invention.

The compressor includes a cylindrical housing 40 for axially twisted rotors 61, 62, 63 and 64 symmetrically spaced about the central flow axis (i.e., the axis of the cylindrical housing 40) and adapted for synchronized rotation. The form of the rotors is apparent from FIGS. 9 and 10 wherein it will be seen that as viewed in transverse cross section the rotors have two lobes with curved tips. The two-lobed plane figures defined by the transverse cross sections of FIGS. 9 and 10 may be generated by using as a generating form a plane figure of the type illustrated in FIGS. 4 through 7 and then generating an enlarged figure representing the locus of points uniformly spaced along lines normal to the basic surface form. The rounded tips are merely arcs formed by a point on a radial line pivoted about the pointed tips.

It will be noted that rotors with this axially twisted surface form do not form a seal when rotated to the position of FIG. 9 but rather leave a small region therebetween. In order to provide the seal a freely rotatable central sealing element 65 is mounted along the flow axis. The element 65 is formed with an axial twist and comprises four ridges (FIGS. 9 and 10) having a pitch corresponding to the pitch of the axial twist formed in the rotors 41, 42, 43, and 44. It will be noted that the sides of the member 65 between the ridges is curved with the radius corresponding to the radii of the tips of the rotors so as to provide a tight seal as illustrated in FIG. 9. The member 65 must be mounted for free rotation since it must turn with the rotors as the tips swing through an arc past the position illustrated in FIG. 9. It will be noted that the pitch of the rotors and, as well as that of the member 65, decreases from the inlet to the outlet end of the compressor so that the volume of the enclosed cavities or chambers decreases from the inlet to the outlet to achieve a compression of the gaseous medium enclosed therein. Obviously the amount of compression may be varied by merely varying the pitch of the rotors.

The cavities or chambers enclosed between the rotors and the central sealing member have an axial length equal to the pitch of the axial twist of the rotors and it will be apparent that they are generally symmetrically shaped about the central sealing member as best illustrated in FIG. 10.

Another alternate embodiment of the invention is achieved by forming the rotors with an increasing or decreasing rotor dimension from one end to the other and then correspondingly mounting the rotors with their respective axes converging or diverging (e.g., pyramid fashion). This technique can be used to achieve greater compression or expansion as will be readily apparent to those skilled in the art.

Figure 11:
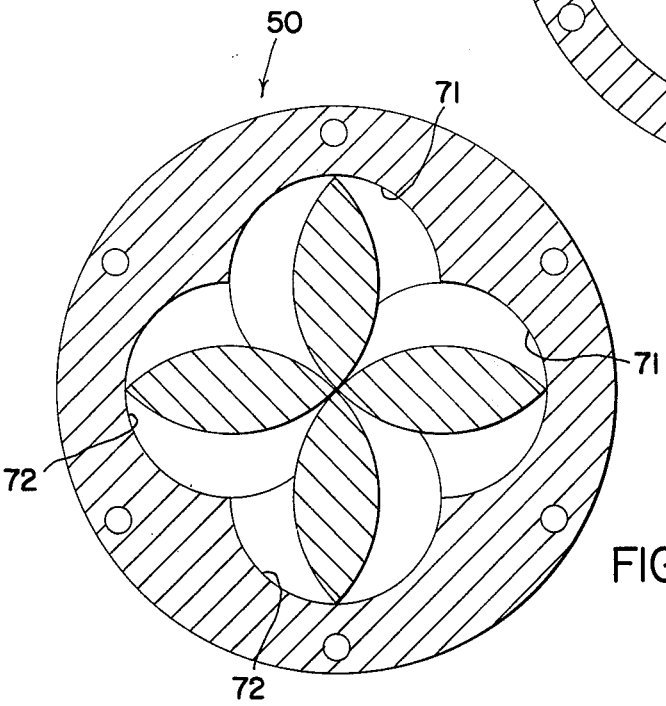
FIG. 11 is a transverse sectional view illustrating a houisng with an alternate form of interior wall contour.

According to still another alternate form of the invention the rotors may be provided with tip seals to afford a more efficient sealing of the closed cavities. When such seals are used it is advantageous to form the housing with four symmetrical lobes defined by the interior wall as illustrated in FIG. 11. The lobes comprise surfaces of revolution about the rotor axes and has a radius approximately equal to the radius to the rotor tip. Thus the lobes assist in retaining the tip seals in their seats during rotor rotation.

It will be understood that additional rotors may be combined with the required minimum of four to obtain one or more additional four rotor groups about one or more additional flow axes. Thus any number of additional paths for groups of closed cavities may be obtained to suit the circumstances.

While the invention has been shown and described with respect to specific embodiments thereof this is intended for the purpose of illustration rather than limitation and other variations and modifications will be readily apparent to those skilled in the art within the intended spirit and scope of the invention. Accordingly, the patent is not to be limited in scope and effect to the specific embodiments herein shown and described nor in any other way that is inconsistent with the extent to which the progress in the art has been advanced by the invention.

I claim:

1. A rotary, positive displacement, progressing cavity device comprising:

a fluid inlet and a fluid outlet in spaced relation relative to a central flow axis, four inter-engaging helical rotors symmetrically spaced around said central flow axis and mounted for rotation about their respective axes of symmetry, said rotors, as viewed in transverse cross section, defining four, two-lobed plane figures with curved tips, each in the same orientation relative to a radial line from its axis to said central flow axis and in engagement with the two adjacent plane figures throughout the synchronized rotation thereof, to define therebetween an enclosed region that varies from a maximum area when said plane figures are oriented perpendicular to their respective radial line to a minimum area when said plane figures are oriented in alignment with said radial line, each rotor having a helical surface form generated by translating its respective two-lobed plane figure along its respective rotor axis while rotating said plane figure thereabout, and a central sealing element mounted for free rotation about said flow axis and having an axial twist with a pitch corresponding to the pitch of the helices formed in said rotors, said sealing element as viewed in transverse cross section defining four concave sides with radii corresponding to the curved tips of said rotors to provide a tight seal therewith at axial locations whereat said two-lobed plane figures are oriented in alignment with their respective radial lines, whereby said rotors and said sealing element define therebetween closed cavities symmetrical about said axis and in aligned endwise relation, that progress axially along said central flow axis from said inlet to said outlet in response to synchronized rotation of said rotors and said sealing element.

2. A device as defined in claim 1 wherein said closed cavities have a generally constant volume throughout their movement along said flow axis.

3. A device as defined in claim 1 wherein said rotor axes are parallel to said central flow axis.

* * * * *